US006572417B2

(12) United States Patent
Katsuma

(10) Patent No.: US 6,572,417 B2
(45) Date of Patent: Jun. 3, 2003

(54) MALE TERMINAL FITTINGS AND MALE CONNECTOR TO WHICH MALE TERMINAL FITTINGS ARE MOUNTED

(75) Inventor: Takatoshi Katsuma, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/996,689

(22) Filed: Nov. 30, 2001

(65) Prior Publication Data

US 2002/0106943 A1 Aug. 8, 2002

(30) Foreign Application Priority Data

Feb. 7, 2001 (JP) ..... 2001-031462

(51) Int. Cl.[7] ..... H01R 13/514
(52) U.S. Cl. ..... 439/752.5; 439/884
(58) Field of Search ..... 439/752.5, 884

(56) References Cited

U.S. PATENT DOCUMENTS 5,207,603 A * 5/1993 Peloza ..... 439/872
5,226,839 A * 7/1993 Koumatsu et al. ..... 439/595
5,681,192 A * 10/1997 Kobayashi et al. ..... 439/884
5,989,079 A * 11/1999 Seko et al. ..... 439/745
6,068,524 A * 5/2000 Koumatsu ..... 439/752.5
6,390,860 B2 * 5/2002 Shirouzu et al. ..... 439/595

FOREIGN PATENT DOCUMENTS

JP 2-73070 6/1990

* cited by examiner

*Primary Examiner*—Lynn D. Feild
*Assistant Examiner*—Thanh-Tam Le
(74) *Attorney, Agent, or Firm*—Greenblum & Bernstein, P.L.C.

(57) ABSTRACT

A reinforcement rib is provided at a bottom connecting wall between a tab part and a main body part of a terminal fitting. The rear end of the rib extends slightly past the front end position of the main body part, and the front end of the rib is formed to extend to a position slightly forward of the rear end of the tab part. Also, the rib is formed to have a generally U-shaped cross-section. Accordingly, reinforcement of the boundary portion is possible, and even though a stress is concentrated on the boundary portion between the tab part and the main body part, the possibility of deformation can be reduced. Thus, male terminal fittings are provided in which deformation at the boundary portion of the tab part and the main body part rarely occurs.

8 Claims, 3 Drawing Sheets

MALE TERMINAL FITTINGS AND MALE CONNECTOR TO WHICH MALE TERMINAL FITTINGS ARE MOUNTED

BACKGROUND OF THE INVENTION

1. Field of the Invention

The present invention relates to male terminal fittings which are inserted in female terminal fittings and carry out an electrical connection, and a male connector to which the male terminal fittings are mounted.

2. Description of Background Information

Male terminal fittings which are inserted into female terminal fittings and carry out an electrical connection are known, and an example of such a terminal fitting having a tab part 2 is shown in FIG. 7.

The male terminal fittings 1 are formed by bending an article which has been obtained by stamping a metal plate into a form having a main body part 3 and a flat tab part 2 that extends forwardly in a cantilever fashion in an axial direction of the fitting.

Since the tab 2 continues from the main body part 3 while the length and thickness are being formed, there has been a concern that the entire tab part 2 may be bent at the point where excessive stress is concentrated at the boundary portion with the main body part 3.

The present invention was completed based on the above circumstances, and a purpose is to provide male terminal fittings in which deformation at the boundary portion of the tab part with the main body part rarely occurs.

SUMMARY OF THE INVENTION

According to one aspect of the present invention, male terminal fittings are provided to include a tab part, which forms a connecting part with a mating terminal, located in front of a main body part. A reinforcing rib is provided that extends from the tab part of the male terminal fitting to the main body part along an axial direction of the male terminal fitting.

In another aspect of the present invention, the reinforcing rib is deformed inwardly toward the inner side of the male terminal fitting.

In a further aspect of the present invention, the reinforcing rib is deformed inward toward the inner side of the male terminal fitting, and a male connector housing includes a reinforcing protrusion, which is positionable within the inwardly deformed rib, is formed at a position that corresponds to the inwardly deformed rib.

Since the reinforcing rib is formed at a region extending from the tab part to the main body part along an axial direction, reinforcement of the boundary portion of the tab part and the main body part becomes possible. Accordingly, the tab part is rarely deformed even if a stress is concentrated on the boundary portion of the tab part and the main body part.

In mounting the male terminal fittings in the male connector housing, when the male terminal fittings are inserted into the inner part of the male connector housing from the edge of the tab part and guided to the inner wall face of the male connector housing, the mounting proceeds. At this time, since the reinforcing rib is provided on the inside of the male terminal fittings, interference with the inner wall face of the male connector housing that may prevent of the guiding can be avoided. Accordingly, the smooth insertion of the male terminal fittings to the male connector housing becomes possible. Further, since a protrusion which interfits in the inwardly deformed part of the rib is provided in the inner wall face of the connector housing corresponding to the rib, reinforcement of the inner wall face can be provided.

According to another aspect of the present invention, a male terminal fitting for mounting in a connector housing is provided. The male terminal fitting includes a main body part configured to connect with an electrical conductor, a tab part configured to connect with a mating female terminal, the tab part being located forwardly of the main body part, and a wall interconnecting the main body part and the tab part. At least one reinforcement rib is provided on the wall to inhibit bending of the tab part relative to the main body part. The reinforcement rib may extend from just forwardly of a rear end of the tab part to just rearwardly of a front end of the main body part along an axial direction of the male terminal fitting.

In another aspect of the present invention, the male terminal fitting may be formed from a flat conductive material, and the reinforcement rib may be formed to project outwardly from the wall toward an outer side of the male terminal fitting. The reinforcement rib may also have one of a generally U-shaped configuration and a generally V-shaped configuration, and the reinforcement rib may be configured as one of a continuous rib and a plurality of spaced projections.

In a further aspect of the present invention, the male terminal fitting may be formed from a flat conductive material, and the reinforcement rib may be formed to project inwardly from the wall toward an inner side of the male terminal fitting. Additionally, the reinforcement rib may have one of a generally U-shaped configuration and a generally V-shaped configuration, and the reinforcement rib may be configured as one of a continuous rib and a plurality of spaced projections.

In a still further aspect of the present invention, an electrical connector is provided that includes at least one male terminal fitting that includes a main body part configured to connect with an electrical conductor, a tab part configured to connect with a mating female terminal, the tab part being located forwardly of the main body part, a wall interconnecting the main body part and the tab part, and at least one reinforcement rib provided on the wall to inhibit bending of the tab part relative to the main body part. The electrical connector also includes a connector housing having at least one cavity configured to receive the male terminal fitting, the connector housing having a complementary formation within the cavity that interfits with the reinforcing rib during insertion of the male terminal fitting into the cavity, whereby the male terminal fitting is guided into the cavity during insertion.

In a further aspect of the present invention, the reinforcement rib is formed to project outwardly from the wall toward an outer side of the male terminal fitting, and the complementary formation includes an inwardly extending recess formed in the connector housing.

In a further aspect of the present invention, the reinforcement rib is formed to project inwardly from the wall toward an inner side of the male terminal fitting, and the complementary formation comprises an outwardly extending rib formed in the connector housing.

BRIEF DESCRIPTION OF THE DRAWINGS

The present invention is further described in the detailed description which follows, by reference to the noted plurality of drawings by way of non-limiting examples of preferred embodiments of the present invention, in which like reference numerals represent similar parts throughout the several views of the drawings, and wherein.

DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The operation of the present invention is illustrated below based on the attached drawings.

Figure 1:
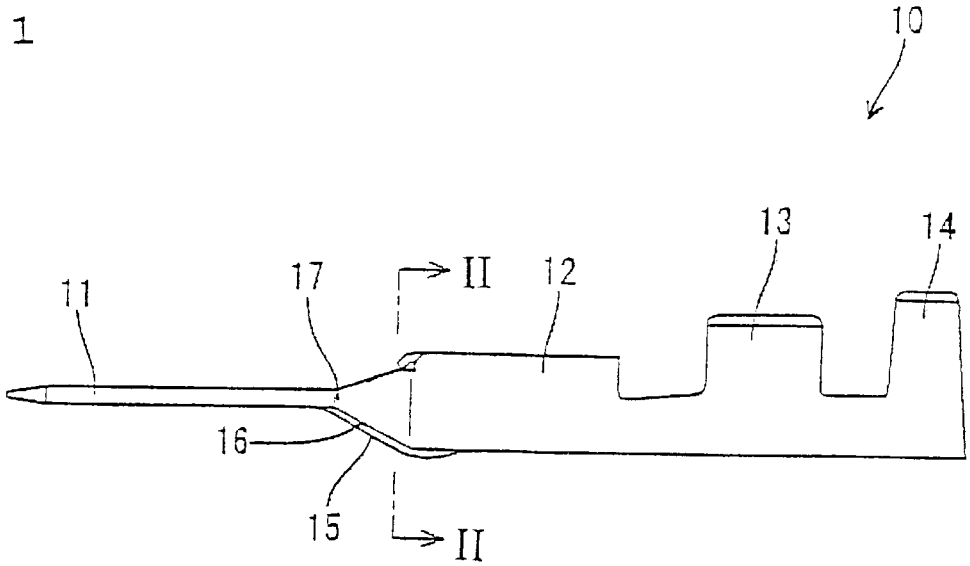
FIG. 1 is a side view of a male terminal fitting according to an embodiment of the present invention.
Figure 2:
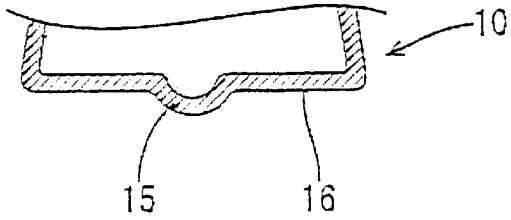
FIG. 2 is a cross-sectional view taken along the line II—II of FIG. 1.
Figure 3:
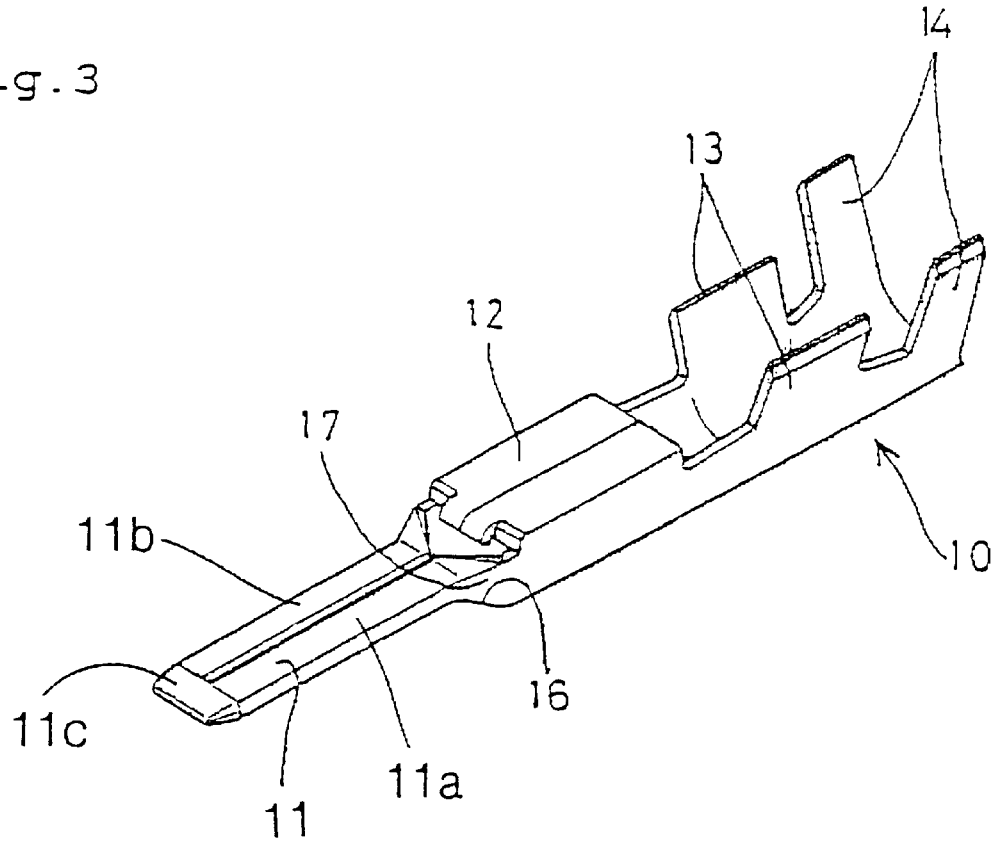
FIG. 3 is a perspective view of a male terminal fitting according to an embodiment of the present invention.

A first embodiment of the present invention is illustrated according to FIGS. 1–3. In FIG. 1, a male terminal fitting is depicted that is made of a suitable electrically conductive material, such as metal. The male terminal fittings 10 are formed by bending an article which has been obtained by stamping a metal plate into a form including a tab part 11, a main body part 12, and barrel parts 13 and 14.

As shown in FIG. 3, the barrel parts 13 and 14 are provided at the rear portion of the main body part 12. The barrel parts are divided into a wire barrel 13 to which a core wire of an electric wire (not illustrated) is clamped, and an insulation barrel 14 to which the end of an electric wire insulation coating is clamped. The main body part 12 is formed in a box shape, and bent so that confronting edges come together at a central location in a longitudinal direction of a ceiling face.

The tab part 11 is sequentially provided at the front end of the main body part 12. Two side rim parts 11*a* and 11*b*, in a longitudinal direction of the tab part 11, are also bent toward the center of the upper face. The side rim parts are bent so that the rim edges are mutually placed on opposite sides of a central axis line at the transverse center. Further, only the end 11*c* of the tab part 11 is closely folded rearwardly. Further, the lower face and both side faces are continuous between the main body part 12 and the tab part 11. Namely, the lower face and both side faces continue from the main body part 12 through the bottom part connecting wall 16 and the side part connecting wall 17, respectively. The bottom part connecting wall 16 extends obliquely toward the upper side of the tab part 11 from the main body part 12. Thus, the tab part 11 is positioned at an elevated position relative to the bottom face of the main body part 12.

Additionally, a reinforcement rib 15 (FIGS. 1, 2 and 4) is formed at a central position in a transverse direction in the bottom portion of connecting wall 16 along the axis line, by deforming the material of the terminal outwardly. As shown in FIG. 1, the rear end portion of the rib 15 extends forwardly from the front end of the main body part 12 and extends to a position slightly rearward of the front end of main body part 12. Also, the front end of rib 15 is formed over a range from the rear end of the tab part 11 to slightly forward of the rear end. Further, as shown in FIG. 2, the rib 15 is formed to have a generally U-shape in cross-section, and is configured to reduce the insertion resistance during insertion of the male terminal into the connector housing.

According to the first embodiment of the invention, since the rib 15 protrudes along the portion from the tab part 11 to the main body part 12, reinforcement of the boundary portion in the axial direction becomes possible. Accordingly, even through a stress is concentrated on the boundary portion between the tab part 11 and the main body part 12, the possibility of deformation can be reduced.

Figure 4:
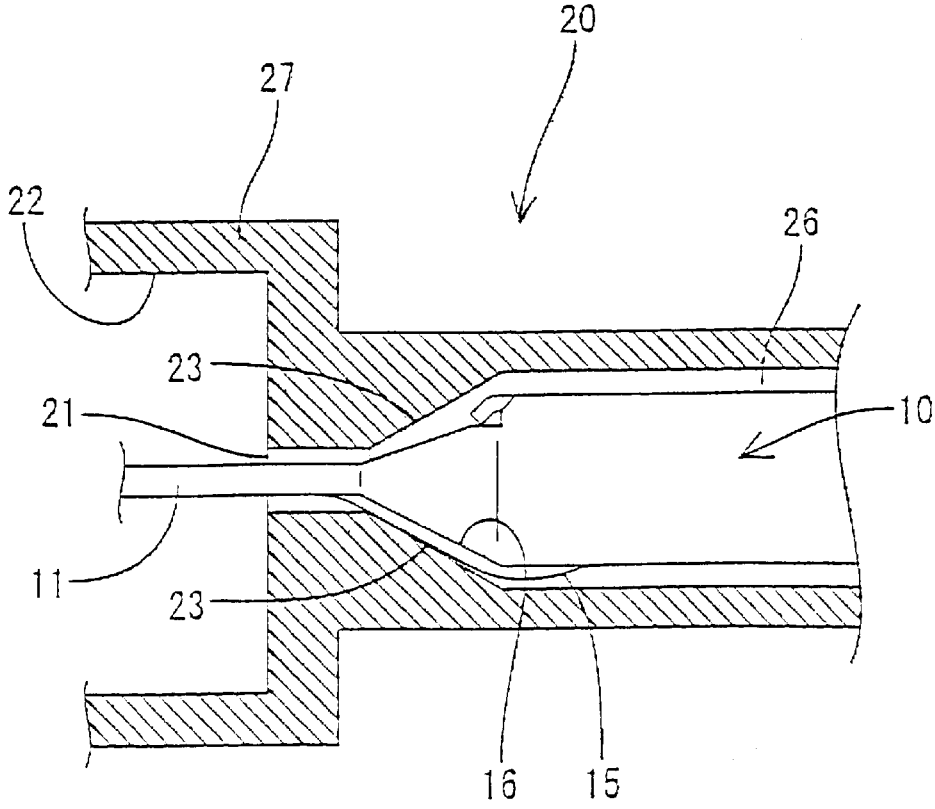
FIG. 4 is a partial cross-sectional view showing an aspect in which the male terminal fittings of the first embodiment are mounted on a male connector housing.

Next, a second mode embodiment of the present invention is explained with reference to FIGS. 4–6. The difference between the first embodiment is the direction of formation of the rib 15. Since the other elements and construction is the same as the first embodiment, the same reference identifiers are applied to the same elements, and the structure, operation and effect will be described in detail.

In the first embodiment, the rib 15 was provided to protrude to the outside of the male terminal fitting 10. However, as shown in FIG. 4, when the male terminal fittings 10 are used by being inserted in the male connector housing 27, the following concerns are raised when the rib 15 protrudes toward the outer face.

The insertion hole 21 for inserting the tab part 11 is penetrated into the male connector housing 27. Further, the inducting part 23 which is formed to taper toward the insertion hole 21 is usually formed at the inlet of the insertion hole 21, but there is a concern that the tab part 11 cannot be smoothly inserted in the insertion hole 21 because the rib 15 becomes hung up on the inducting part.

Figure 5:
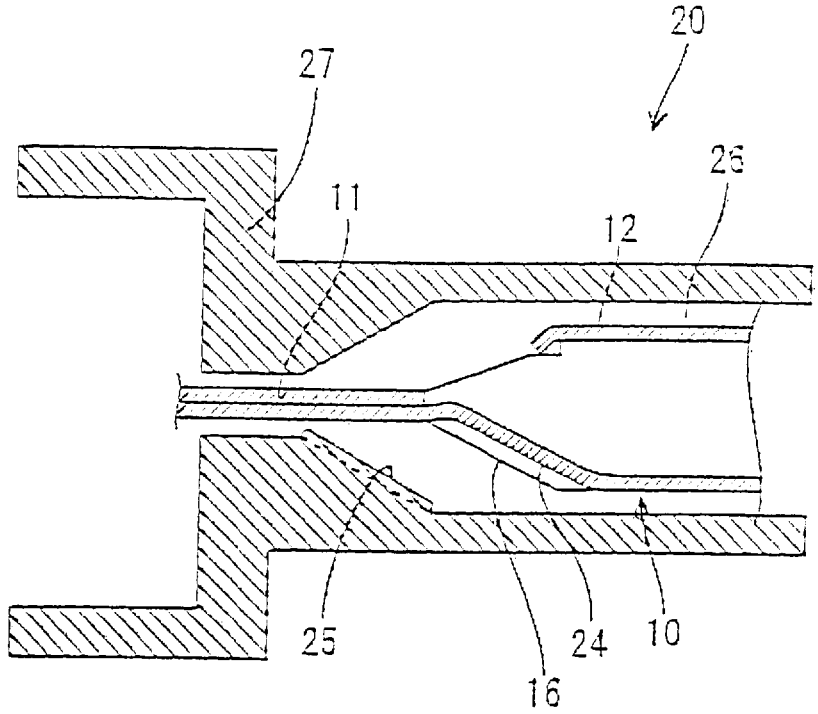
FIG. 5 is a cross-sectional view showing an aspect in which male terminal fittings in a second embodiment of the present invention are mounted on a male connector housing.
Figure 6:
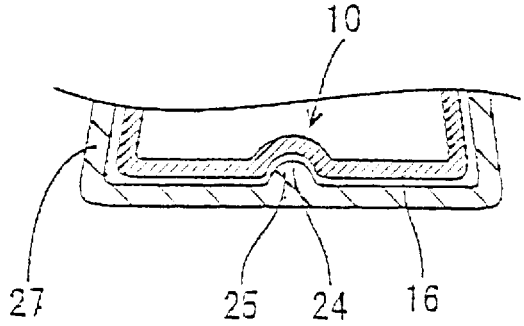
FIG. 6 is a cross-sectional view showing a condition in which a protrusion is fitted within a recess formed by a rib.
Figure 7:
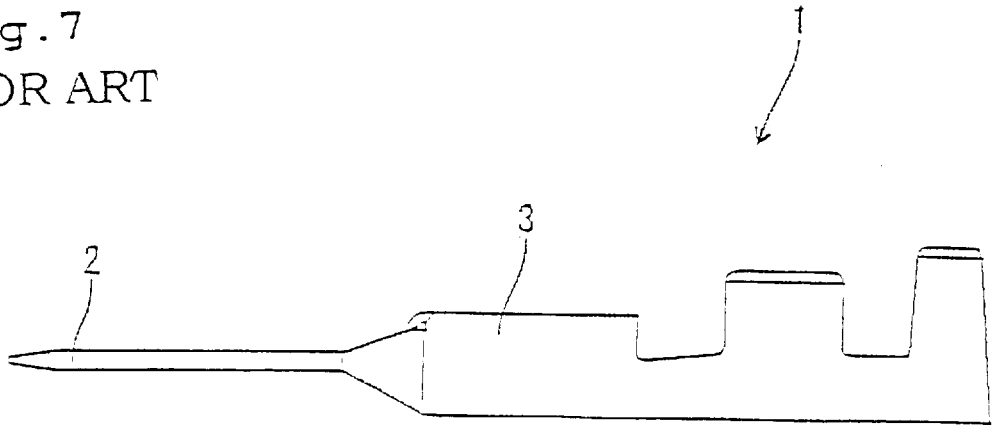
Fig.7 PRIOR ART
FIG. 7 is a side view of a conventional male terminal fitting.

In the second embodiment, considering the above-mentioned situation, the rib 24 is not formed to protrude outwardly, but is designed to be formed by being deformed inwardly (refer to FIGS. 5 and 6). Thus, the interference with the inducting part 23 and the like are avoided, and the effect of smoothly inserting the tab part 11 is obtained.

Further, the following beneficial results are obtained by inwardly deforming the rib 24. For example, in case of a small size male connector 20, the wall thickness of the cavities 26 in the male connector housing 27 is not adequately provided. Then, in such a case, if the form of the rib 15 which protrudes outwardly is utilized, there is a danger that the wall may be broken when the rib 15 engages the wall due to strong force. As a countermeasure, it is considered that grooves and the like are provided for avoiding the rib 15, but such countermeasure cannot be taken for the thin walls of the cavities 26. In the case where the rib 24 is deformed inwardly, to the contrary, a protrusion 25 which interfits with the inwardly deformed rib can be provided. Therefore, reinforcement of the thin walls of the cavities 26 is also provided. Further, since the inwardly deformed rib 24 interfits with the protrusion 25, vibration of the male terminal fittings 10 is also stopped, and a stable mounting of the male connector housing 27 with the male terminal fittings 10 is provided.

The present invention is not limited to the embodiments illustrated by the above-mentioned descriptions and drawings, and for example, the following embodiments are also included in the technical scope of the present invention. Further, the present invention can be carried out by various changes within the scope of the invention without deviating from the purpose, in addition to the description below.

(1) In the aforementioned embodiment, only one protrusion was provided for the rib. However, a plurality of protrusions may be formed.
(2) The aforementioned rib was formed to have a generally U-shaped cross-section. However, other cross-sections may be utilized, for example, a generally V-shaped cross-section may be utilized.
(3) The aforementioned rib was formed continuously along the axial direction from slightly behind the front end of the main body part to slightly in front of the rear end of the tab part. However, the rib may be formed by a plurality of point like projections which are intermittently arranged.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present application claims priority under 35 U.S.C. §119 of JP2001-031462, filed on Feb. 7, 2001, the disclosure of which is expressly incorporated herein by its entirety.

What is claimed is:

1. A male terminal fitting comprising:

a tab part that forms a connecting part with a mating female terminal, the tab part being located in front of a main body part; and a reinforcement rib is provided on said male terminal fitting that extends from said tab part of said male terminal fitting to said main body part along an axial direction of said male terminal fitting, wherein said reinforcing rib is deformed inwardly toward an inner side of said male terminal fitting.

2. A male connector comprising:

male terminal fittings including a reinforcing rib deformed inwardly toward an inner side thereof; and a male connector housing including a reinforcing protrusion positionable within said inwardly deformed rib, said reinforcing protrusion is formed at a position that corresponds to said inwardly deformed rib.

3. A male terminal fitting for mounting in a connector housing, said male terminal fitting comprising:

a main body part configured to connect with an electrical conductor;

a tab part configured to connect with a mating female terminal, said tab part being located forwardly of said main body part;

a wall interconnecting said main body part and said tab part; and at least one reinforcement rib provided on said wall to inhibit bending of said tab part relative to said main body part, wherein said reinforcement rib extends from just forwardly of a rear end of said tab part to just rearwardly of a front end of said main body part along an axial direction of said male terminal fitting;

wherein said male terminal fitting is formed from a flat conductive material, and said reinforcement rib is formed to project inwardly from said wall toward an inner side of said male terminal fitting.

4. The male terminal fitting according to claim 3, wherein said reinforcement rib has one of a generally U-shaped configuration and a generally V-shaped configuration.

5. The male terminal fitting according to claim 3, wherein said reinforcement rib is configured as one of a continuous rib and a plurality of spaced projections.

6. An electrical connector comprising:

at least one male terminal fitting including a main body part configured to connect with an electrical conductor, a tab part configured to connect with a mating female terminal, said tab part being located forwardly of said main body part, a wall interconnecting said main body part and said tab part, and at least one reinforcement rib provided on said wall to inhibit bending of said tab part relative to said main body part; and a connector housing including at least one cavity configured to receive said male terminal fitting, said connector housing including a complementary formation within said cavity that interfits with said reinforcing rib during insertion of said male terminal fitting into said cavity, whereby said male terminal fitting is guided into the cavity during insertion.

7. The electrical connector of claim 6, wherein said reinforcement rib is formed to project outwardly from said wall toward an outer side of said male terminal fitting, and said complementary formation comprises an inwardly extending recess formed in said connector housing.

8. The electrical connector of claim 6, wherein said reinforcement rib is formed to project inwardly from said wall toward an inner side of said male terminal fitting, and said complementary formation comprises an outwardly extending rib formed in said connector housing.

* * * * *